US006320539B1

(12) United States Patent
Matthews et al.

(10) Patent No.: US 6,320,539 B1
(45) Date of Patent: Nov. 20, 2001

(54) FIBER-OPTIC, WIDEBAND ARRAY ANTENNA BEAMFORMER

(75) Inventors: Paul J. Matthews, Springfield; Paul D. Biernacki, Alexandria, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/590,702

(22) Filed: Jun. 9, 2000

(51) Int. Cl.[7] ..... H01Q 3/22
(52) U.S. Cl. ..... 342/375
(58) Field of Search ..... 342/375

(56) References Cited

U.S. PATENT DOCUMENTS

| | | | | |
|---|---|---|---|---|
| H1625 | | 1/1997 | Frankel | 342/375 |
| 5,333,000 | * | 7/1994 | Hietala et al. | 342/368 |
| 5,374,935 | * | 12/1994 | Forrest | 342/368 |
| 5,933,113 | * | 8/1999 | Newberg et al. | 342/375 |
| 6,137,442 | * | 10/2000 | Roman et al. | 342/375 |

OTHER PUBLICATIONS

TsaP et al.; Phased–Array Optically Controlled Receiver, Using a Serial Feed; IEEE Photo. Techn. LTTRs; vol. 10, No. 2; pp. 267–269; Feb. 1998.

Frankel et al.; True Time–Delay Fiber–Optic, Control of an Ultrawideband Array Transmitter/Receiver with Multi Beam Capability; IEEE Trans. Micro. Theory and Techn. vol. 43, No. 9; pp. 2387–2393; Sep. 1995.

Román et al.; Time–Steered Array with a Chirped Grating BeamFormer; Electr. Lttrs; vol. 33, No. 8.; pp. —; Apr. 1997.

Frankel et al.; Two–Dimensional Fiber–Optic Control of a True Time–Steered Array Transmitter; IEEE Trans. Micro. Theory and Techn; vol. 44, No. 12; pp. 2966–2702; Dec. 1996.

Román et al.; Time–Steered Array with a Chirped Grating BeamFormer; Proc. 1997 Optical Fiber Comm. Conf., vol. 6; paper PD. 28, pp. 479–482; Dallas, Tx, Feb. 16–21, 1997.

Zmuda et al.; Photonic BeamFormer for Phased Array Antennas Using a Fiber Grating Prism; IEEE Photonic Techn. Lttrs; vol. 9, No. 2; pp. 241–243, Feb. 1997.

Cruz et al; Chirped Fibre Bragg Gratings for Phased–Array Antennas; Elect. Lttrs; vol. 33; No. 7; pp. 545–546; Mar. 1997.

Soref; Fiber Grating Prism for True Time–Decay Beamsteering; Fibre and Integrated Optics; vol. 15; pp. 325–333, 1996.

* cited by examiner

*Primary Examiner*—Theodore M. Blum
(74) *Attorney, Agent, or Firm*—John J. Karasek; Charles J. Stockstill

(57) ABSTRACT

This is a technique using a fiber-optic, wideband array antenna beamformer having cascaded, chirped fiber gratings in a distributed architecture based upon the use of cascaded, fiber-optic, chirped Bragg gratings in a distributed architecture for use in wideband, time-steered array antennas. A wavelength tunable laser serves as a carrier for a microwave signal which is modulated upon it. The signal is corporately distributed to each feed of the array. Each feed then traverses a multi-port optical circulator and is reflected off a number of identical, chirped fiber gratings proportional to their position within the array. The signal is then demodulated and fed to the appropriate antenna element. All gratings are identical with the same length and dispersion (ps/nm). Time-steering is accomplished by tuning the laser wavelength such that the effective reflection point in an individual grating is changed due to the chirped nature of the grating.

22 Claims, 2 Drawing Sheets

FIBER-OPTIC, WIDEBAND ARRAY ANTENNA BEAMFORMER

BACKGROUND OF THE INVENTION

1. Field of the Invention

Generally, this invention regards an fiber-optic, wideband array antenna beamformer and more specifically a fiber-optic, wideband array antenna beamformer using cascaded, chirped fiber gratings in a distributed architecture.

2. Description of the Related Prior Art

A large variety of current military and commercial array antenna systems require wide instantaneous bandwidths enabled through the use of a time-steered beamformer. Due to the lack of a feasible microwave alternative, much research has gone into the use of optical and photonic techniques for control of time-steered antennas. There have been numerous proposals and attempts to develop true time-delay capability optical beamformers. However, most of these techniques have not progressed beyond conceptual laboratory demonstrations, as they are hampered by the demands for precisely matched optical elements, excessive power losses, instability, or specialized component development. One of the most successful techniques for time-steered optical beamforming is the dispersive prism technique developed by Frankel et al. at the Naval Research Laboratory. See, Frankel et al.; TRUE TIME-DELAY FIBER-OPTIC CONTROL OF AN ARRAY TRANSMITTER/RECEIVER WITH MULTIBEAM CAPABILITY; IEEE Trans. Microwave Theory Techn.; Vol. 43; No. 9; pp. 2387–2394; September 1997. Although successful, this technique has some notable drawbacks directly stemming from the use of long lengths of high dispersion fiber. The long fiber lengths resulted in a system with environmental and temperature sensitivity and instability, a significant signal latency through the beamformer and a physically large system.

A number of beamforming architectures based on the substitution of fiber Bragg gratings for a high dispersion fiber have been implemented. There are the discrete fiber grating beamformer, a serially fed discrete fiber grating beam former, and a chirped fiber grating beamformer.

In the discrete fiber grating beamformer, as described by Zmuda et al., PHOTONIC BEAMFORMER FOR PHASED ARRAY ANTENNAS USING FIBER GRATING PRISM, IEEE Photon. Technol. Techn. Lett., Vol 9, pp. 241–243, 1997, a tunable delay line consists of a series of discrete fiber Bragg gratings having different periods. Each grating is designed to reflect a particular optical wavelength. The gratings are spaced a prescribed distance apart such that the required time-delay may be chosen by selecting the wavelength corresponding to the desired grating position. An antenna array may be fabricated by feeding each element with a custom delay line having a grating spacing proportional to the element position. The drawbacks of this scheme are that it requires many gratings, the beamsteering is discrete rather than continuous, the number of beam positions are very limited due to fiber grating limitations, and it requires accurate, precise spacing of the gratings in order to achieve time delays.

The serially fed discrete fiber grating beamformer is similar to the discrete fiber grating beamformer, but utilizes a single discrete grating delay line. See, Tsap et al., PHASED-ARRAY OPTICALLY CONTROLLED RECEIVER USING A SERIAL FEED; IEEE Photonics Techn. Lett.; PP. 267–269; Febuary 1998. The elements of the antenna array are controlled by serially gating the optical signal. This technique still suffers from the same drawbacks as the discrete fiber grating beamformer, and in addition, the types of microwave signals that can be handled is severely restricted.

A chirped fiber grating beamformer is an attractive alternative to overcome the problems associated with the discrete fiber grating beamformers set forth above. A continuously tunable delay line can be realized with a single chirped grating because the grating period varies continuously along the grating length. See, Cruz et al., CHIRPED FIBRE GRATINGS FOR PHASED-ARRAY ANTENNAS, Electron. Lett., Vol. 33, p. 545, 1997. A chirped grating beamformer in which every element is fed by a delay line having a chirped grating with a different length and chirp was proposed. See, Soref, FIBER GRATING PRISM FOR TRUE TIME DELAY BEAMSTEERING, Fiber and Integrated Optics, Vol. 15, pp. 325–333, 1996. Implementation of this beamformer for any practical array antenna is difficult for a number of reasons. First, because typical antennas require many nanoseconds of delay for proper steering, chirped fiber gratings with lengths in excess of 50 centimeters are needed. Such gratings have been demonstrated in a research environment but are not currently available. Also, this approach requires that the gratings be proportionally and precisely matched in length and chirp. Although this architecture has been proposed, it has not been demonstrated.

To circumvent these deficiencies, it was proposed and demonstrated to replace the long chirped fiber gratings in the system with identical, cascaded, chirped fiber gratings in a serial architecture where a single fiber grating might be common to numerous time-delay feeds in the system. See, Roman et al., TIME-STEERED ARRAY WITH A CHIRPED GRATING BEAMFORMER, Proc. 1997 Optical Fiber Comm. Conf., Dallas, Tex., February 16–21, Vol. 6, paper PD-28, pp. 479–482, 1997; Roman et al., entitled CHIRPED FIBER GRATING BEAMFORMER FOR PHASED ARRAY ANTENNAS, Ser. No. 09/058,352, filed Apr. 1, 1998. This design has some disadvantages which make it impractical in many applications. First, the design is not optically efficient in its current proposed form due to its serial architecture in which a portion of the signal from each feed is used to feed the next element in the array. Since array antennas nominally require a uniform amplitude in the feeds to the elements, all feeds in the serial architecture must be normalized to the smallest amplitude. Thus, while this approach minimizes the number of fiber gratings and optical circulators, it wasted optical power when standard 50% couplers are used, resulting in a low optical power at the photodetector. Low optical powers result in very poor microwave system performance rendering this approach useless for most applications. This may be partially remedied using custom proportional taps that are not commercially available. However, a straight forward analysis reveals that the tolerances required for such taps are not realizable, especially when they must be maintained over the wavelength tuning range. Second, the serial design is susceptible to single point failures. For instance, if the first fiber grating failed then all subsequent feeds would also fail.

SUMMARY OF THE INVENTION

The object of this invention is to improve fiber-optic, wideband array antenna beamforming architectures for use in wideband, steered array antennas.

Another object of this invention is to provide for signal remoting of array antenna signals over long distances.

These and other objectives are achieved by a fiber-optic, wideband array antenna beamformer using cascaded, chirped fiber gratings in a distributed architecture. The technique is based upon the use of cascaded, fiber-optic, chirped Bragg gratings in a distributed architecture. A wavelength tunable laser serves as a carrier for a microwave signal which is modulated upon it. The signal is corporately distributed to each feed of the array. Each feed then traverses a multi-port optical circulator and is reflected off a number of identical, chirped fiber gratings proportional to their position within the array. The signal is then demodulated and fed to the appropriate antenna element. All gratings are identical with the same length and dispersion (ps/nm). Time-steering is accomplished by tuning the laser wavelength such that the effective reflection point in an individual grating is changed due to the chirped nature of the grating.

DESCRIPTION OF THE PREFERRED EMBODIMENT

Figure 1:
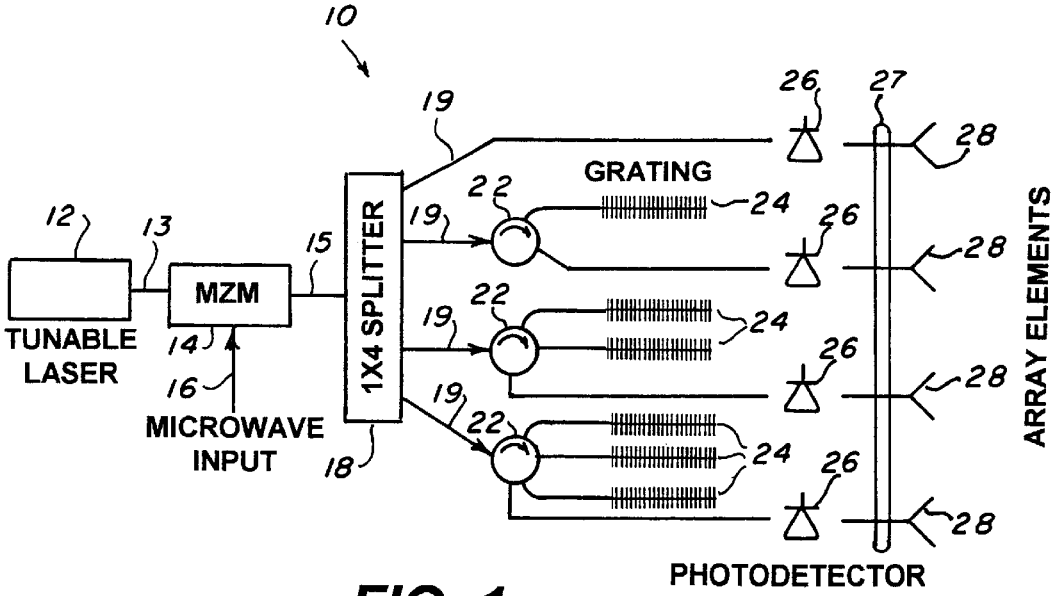
FIG. 1 shows a four-element (feed) cascaded, fiber grating transmit beamformer architecture.

In a fiber-optic, wideband array antenna beamformer using cascaded, chirped fiber gratings 10, as shown in FIG. 1, a wavelength tunable laser 12 serves as a carrier 13 for a microwave signal 16 which is modulated upon it in an optical modulator 14, such as a Mach-Zehnder optical modulator or any other type well known to those skilled in the art. The optically modulated microwave signal 15 is corporately distributed to each feed 19 of the array 27 through a splitter 18. Each feed 19 then traverses a multi-port optical circulator 22 and is reflected off a number of identical, chirped fiber gratings 24, such as a modulated core-index or any other type well known to those skilled in the art, proportional to the position of the feed 19 within the array 27. The optically modulated microwave signal 15 is then demodulated by an associated photodetector 26 and fed to an appropriate associated antenna element 28. All gratings 24 are identical with the same length and dispersion (ps/nm).

Time-steering is accomplished by tuning the laser 12 wavelength such that the effective reflection point in an individual grating 24 is changed due to the chirped nature of the grating 24. Given as linear chirp, F, which is inversely proportional to the dispersion, an individual grating 24 will give a linear time-delay described by:

$$\Delta t = D_g(\lambda - \lambda_0) + NL/c$$

where $D_g$ is the grating 24 dispersion (ps/nm), $\lambda_0$ is the center wavelength of the grating 24 reflection spectrum, N is the effective index of the guided mode, and L is the grating 24 length. The transmitted component undergoes a constant time-delay NL/c. Since the grating 24 dispersion is additive, two gratings 24 will give twice the time-delay, etc. This results in a linear time-delay gradient across the array antenna 28 output which is the condition required for beamsteering. It should be noted that either positive or negative dispersion gratings 24 may be employed in the system 10 which may reduce complexity. Also, the gratings 24 may be used in conjunction with high-dispersion fiber which may be advantageous in certain applications. The description reflects reflective fiber gratings 24 but transmissive gratings 24 may also be employed. Multi-port optical circulators 22 are taught but cascaded 3-port circulators 22 may also be used. In general, the $n^{th}$ time delay feed has (n−1) gratings 24 leading to a time delay of (n−1)Δt.

Figure 2:
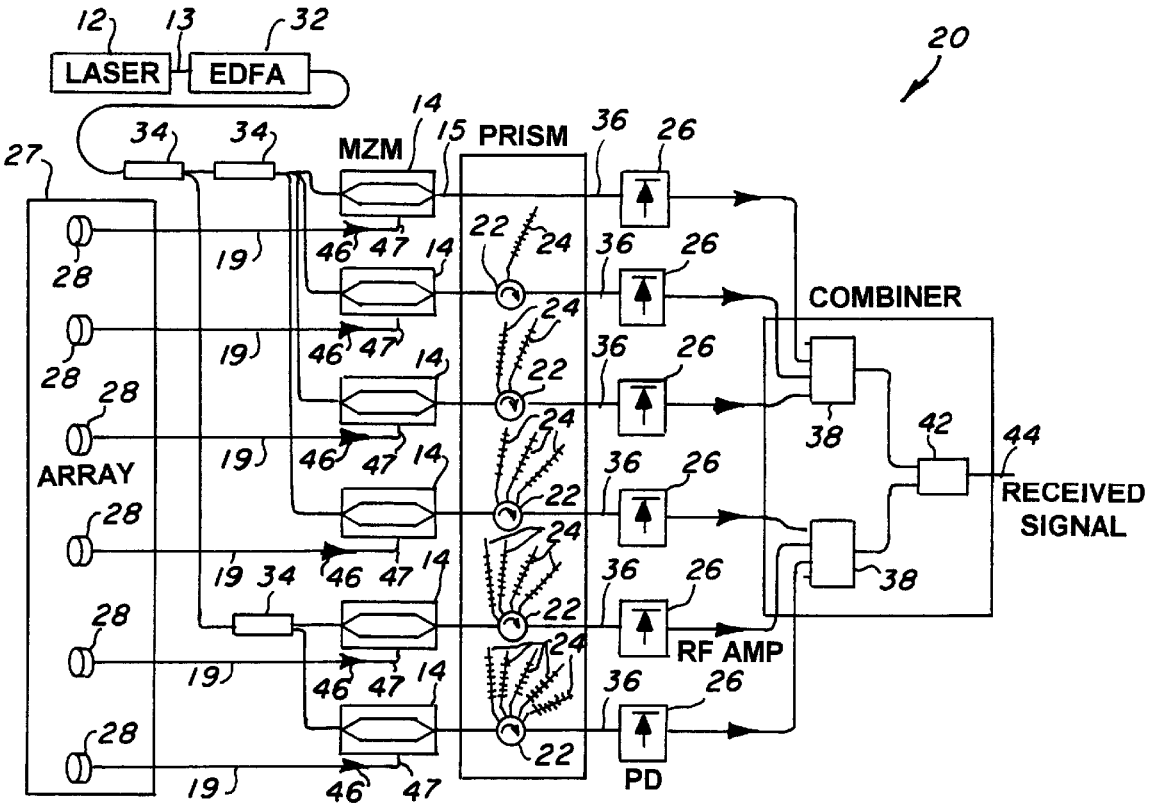
FIG. 2 shows a six-element (feed), cascaded, fiber grating receive beamformer with FIG. 3*a* shows the measured time-delay characteristics for each feed in the array.

In a 6-element beamformer 20, as shown in FIG. 2, the gratings 24 are fabricated from a holographically written phase mask, a technique well known to those skilled in the art. Both the phase mask and gratings 24 are commercially available. The gratings 24 are designed for a 6-element array 27 with 4.3 inch antenna element 28 spacing, however, other element 28 spacing may be utilized, capable of steering to ±60°. The gratings 24 are 10.0 centimeters long in this instance, with a nominal dispersion of 24.5 ps/nm and a 40 nanometer optical beamwidth. It should be noted that such a system 20 would require time-delays of up to 3 nanoseconds corresponding to a 35 centimeter long grating 24. It is to be noted that a grating's 24 quality tends to decrease with increasing length.

Tracing a signal through the circuit shown in FIG. 2, the incident microwave energy collected by each of the six spiral elements 28 is amplified by phase and gain matched low noise microwave amplifiers (LNAs) 46. These signals 47 are then fed to six electro-optic optical modulators 14 which amplitude modulate the optical carrier 13. The optical carrier 13 is provided by a wavelength tunable, external cavity laser 12 which is subsequently amplified by an optical amplifier 32 (EDFA) before being split to the optical modulators 14.

After modulation by the optical modulators 14, the optically modulated microwave signal 15 for each feed 19 is reflected off a number of fiber Bragg gratings 24 proportional to the position of the feed 19 in the array 27. The signal is properly routed using a multi-port optical circulator 22. All paths are equalized in amplitude (using optical attenuators 34) and in time (to within 1 picosecond) at a center wavelength of 1550 nm corresponding to broadside (0° from any array 27 normal) beamsteering. Final time trimming is performed with the use of variable microwave delay lines (trombones). Thus, the beamformer provides a time delay (dispersion) per channel that is proportional to the position in the array 27 as well as the wavelength change from 1550 nm. The dispersion is continuous and linear over the optical bandwidth of the system 20 allowing for continuous tuning of the time delay on each channel, limited only by the wavelength resolution of the tunable laser 12 and the time-delay error of the grating 24. The time-delayed optical signals 36 from each feed 19 are demodulated using photodetectors 26, amplified using LNAs 38 and combined using a microwave combiner 42, outputting an electrical signal 44 for application to a receiver (not shown).

Figure 3A:
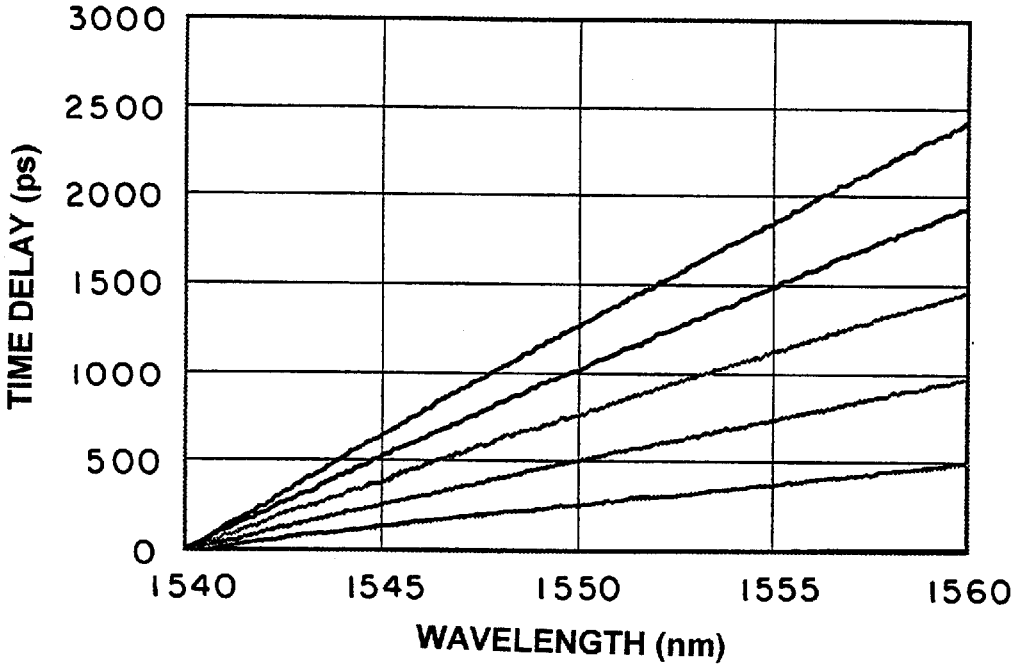
FIG. 3*b* shows the differences in measured time-delay characteristics of five gratings.
Figure 3B:
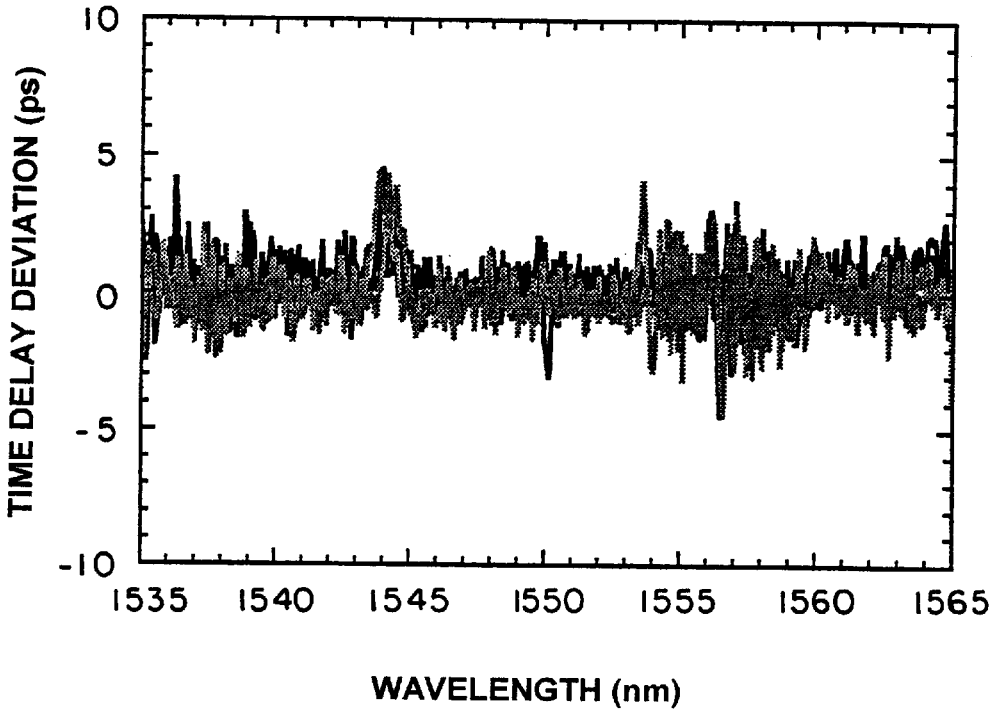

The gratings 24 used in the beamformer are thoroughly characterized for their amplitude and time-delay characteristics. The measured time-delay characteristics for each feed 19 in the array 27 are shown in FIGS. 3*a* and 3*b*. A macroscopic error appears at a wavelength of ~1544 nm. Since this error appears and is identical in all gratings 24 , it does not affect the beam steering performance. The root-mean-square deviation of all gratings 24 is approximately 1.45 ps.

The architecture taught herein employs a distributed approach using identical, cascaded chirped fiber gratings 24. This allows efficient use of optical power which results in beamformer performance that is superior to that achievable using serial approaches. As an example, a six element beamformer based on this approach using a typical commercial optical modulator 14 and laser 12 and with 500 mW of available optical power will exhibit a microwave loss from input to beamformer output of ~42 dB. A similar serial system using readily available components may exhibit a microwave loss of up to ~62 dB. The decreased loss translates directly into an improved dynamic range and noise figure for the system. This feature is different from that of the serial architecture described above.

The architecture is not prone to single point failures in the gratings 24 or circulators 22 due to the distributed approach. This feature differs from that of the serial architecture described All gratings 24 are nominally identical in terms of length and dispersion. The time delay for each feed 19 is increased linearly along the array by passing the signal through additional identical gratings 24. This allows the system to be immune to macroscopic variations in any individual gratings 24 including a non-linear time-delay as a function of wavelength (non-linear grating 24 chirp). This feature is different from the architecture taught in Soref et al, supra. where different gratings 24 with differing dispersions are utilized.

The use of multi-port circulators 22 greatly simplifies the architecture and reduces the optical losses leading to a higher performance system.

Any type of chirped grating 24 may be employed—reflective, transmissive, negative dispersion, positive dispersion, phase mask or directly written, etc. Both positive and negative dispersion gratings 24 may be used simultaneously to reduce system complexity. Since negative dispersion gratings 24 tend to be more lossy, high dispersion fiber may be judicially used as a negative dispersion element in some cases. The grating 24 chirp can be non-linear to better match the sinusoid steering function of the array 27. Also, the architecture may be scaled to any number of elements 28 by employing more cascaded gratings 24 as described above.

The multi-port circulators 22 may be substituted with an equivalent configuration to achieve the same result. An example is to cascade multiple 3-port circulators which are less expensive and more readily available. A second alternative is to use add-drop multiplexers.

Two-dimensional arrays 27 may be steered by cascading beamformers.

Many of the components are generic and may be changed to implement the system including, but not limited to the laser source 12, photodetector 26, optical modulator 14, splitter and antenna element 28.

The combining for a receive beamformer may be accomplished optically using an N-to-1 optical combiner 42 along with a single photodetector 26 as opposed to the N-to-1 microwave combiner 42 after the photodetectors 26 as discussed above.

Time-delay trimming may be accomplished through any number of means including variable microwave delay lines, fiber-optic variable delay lines such as fiber stretchers or through fiber splicing techniques.

The optical power may be used even more effectively by optimizing the power split to the various feeds in the systems.

All components to implement this system, including the tunable laser 12, optical modulators 14, photodetectors 26, fiber, chirped gratings 24 and optical circulators 22 are available commercially, off-the-shelf. No components development work is required and the system may be immediately implemented as taught.

There is reduced cost compared to the prior art. Using phase-mask technology to fabricate the gratings 24, only one phase mask is required, thus ensuring grating 24 reproducibility and time-delay matching of the antenna elements 28. In contrast, the architecture of the prior art requires a different mask for each feed 19 in the array 27. This adds cost and introduces non-reproducible errors on each grating 24 which may degrade overall performance.

The use of identical chirped gratings 24 eliminates any stitching errors inherent in the discrete grating 24 approaches.

Continuous tuning of the beamsteering angles is possible with this system. Since the gratings 24 are fabricated from a holographically written phase mask, the period variation within the grating 24 is continuous. Consequently, the beamsteering angle resolution is only limited by to the tuning resolution of the laser 12 and the grating 24 time-delay errors. This is in contrast to the architecture of the prior art where the angle resolution is limited by the number of discrete gratings 24 used.

There is minimal signal latency. The delay achievable with a single type grating 24 used in the device taught herein (24.5 ps/nm) dispersion) which has a latency less than a nanosecond is roughly equivalent to 650 meters of high dispersion fiber which has a latency of ~3.2 $\mu$s. The short latency allows fast control (in the nanosecond regime) of the antenna array 27.

The device taught here has a greatly enhanced temperature stability. Along with the reduced latency, the overall shorter lengths of fiber necessary for the architecture reduce the system temperature stability by a factor of ~1000 when compared to an equivalent high-dispersion fiber approach used in the prior art.

Although the invention has been described in relation to an exemplary embodiment thereof, it will be understood by those skilled in the art that still other variations and modifications can be affected in the preferred embodiment without detracting from the scope and spirit of the invention as described in the claims.

What is claimed:

1. A fiber-optic, wideband array antenna beamformer for transmission comprised of:

an optical light source for generating an optical signal;

a first microwave signal;

a plurality of antenna feed lines for transmitting a second microwave signal;

a modulator for modulating the optical signal with said first microwave signal which is applied to each antenna feed line of the plurality of antenna feed lines;

a tunable delay line in each of said antenna feed lines, comprising a plurality of chirped fiber gratings associated with a particular antenna feed line, whereby each feed traverses a multi-port optical circulator and is reflected off a number of said identical, chirped fiber gratings proportional to their position within the array;

a convertor for converting the delayed modulated optical signal to a second microwave signal; and a plurality of antennas forming an array wherein each antenna of the array is associated with a specific delay line for transmitting the second microwave signals.

2. A beamformer, as in claim 1, wherein the optical light source is a wavelength tunable laser.

3. A beamformer, as in claim 1, wherein the means for modulating the optical signal is an optical modulator.

4. A beamforrner, as in claim 1, wherein the chirped fiber gratings are fabricated from a holographically written mask.

5. A beamformer, as in claim 1, wherein the chirped gratings are reflective.

6. A beamformer, as in claim 1, wherein the chirped gratings are transmissive.

7. A beamformer, as in claim 1, wherein the chirped gratings are negative dispersion.

8. A beamformer, as in claim 1, wherein the chirped gratings are positive dispersion.

9. A beamformer, as in claim 1, wherein the chirped gratings are phase mark written.

10. A beamformer, as in claim 1, wherein the chirped gratings are directly written.

11. A beamformer, as in claim 1, wherein the chirped gratings have a positive and negative dispersion grating used simultaneously.

12. A beamformer, as in claim 1, wherein the chirped gratings are linear.

13. A beamformer, as in claim 1, wherein the chirped gratings are non-linear.

14. A beamformer, as in claim 1, further comprising an multi-port optical circulator in predetemined feed lines to direct an optical signal to an associated chirped grating.

15. A beamformer, as in claim 14, further comprising an add-drop multiplexer in predetermined feed lines to direct an optical signal to an associated chirped grating.

16. A beamformer, as in claim 1, wherein a time-delay in the delay line is increased linearly along the array by passing the modulated optical signal through additional identical gratings.

17. A beamformer, as in claim 1, further comprising a device for tuning the optical light source so as to vary the wavelength of the optical light generated by the optical light source to accomplish time-steering such that the effective reflection point in an individual grating is changed due to the chirped nature of the grating.

18. A fiber-optic, wideband array antenna beamformer for reception comprised of:

a wavelength tunable laser generating an optical carrier;

a distribution system for corporately distributing the optical carrier signal to element of an antenna array;

a first microwave signal comprising a plurality of microwave signals;

a plurality of optical modulators for modulating said microwave signal;

said modulated optical carrier traversing a multi-port optical circulator within the array and applied to a device that provides a time-delay trimming within that part of the distribution system associated with a particular device for time-delay trimming; wherein said time-delay trimming comprises a plurality of chirped fiber gratings associated with a particular antenna feed line; and a device associated with each feed for demodulating the modulated optical carrier;

a N−1 microwave combiner to combine multiplexed microwave signals into a single microwave signals.

19. A beamformer, as in claim 18, wherein the modulated optical carrier is reflected off a number of identical, chirped fiber gratings proportional to the position of the position of the gratings provides a time-delay trimming within that part of the distribution system associated with a particular device for time-delay trimming.

20. A beamformer, as in claim 18, wherein the time-delay trimming is accomplished by variable delay lines.

21. A beamformer, as in claim 18, wherein the time-delay trimming is accomplished by fiber optic variable delay lines.

22. A beamformer, as in claim 18, wherein the fiber-optic variable delay line is a fiber stretcher.

* * * * *